United States Patent [19]

Takei et al.

[11] 4,451,213

[45] May 29, 1984

[54] ELECTRICALLY OPERATED FUEL PUMP DEVICE HAVING A REGENERATIVE COMPONENT

[75] Inventors: Toshihiro Takei, Kariya; Kazuma Matsui, Toyohashi; Yoshiyuki Hattori, Toyoake; Kiyohiko Watanabe, Chiryu; Toshiaki Nakamura, Anjo; Shunsaku Ohnishi, Toyota, all of Japan

[73] Assignee: Nippondenso Co., Ltd., Kariya, Japan

[21] Appl. No.: 362,855

[22] Filed: Mar. 29, 1982

[30] Foreign Application Priority Data

Mar. 30, 1981 [JP] Japan ..... 56-46954

[51] Int. Cl.[3] ..... F04B 35/04; F04D 5/00; F01D 3/00

[52] U.S. Cl. ..... 417/366; 417/423 R; 415/53 T; 415/106; 415/213 T

[58] Field of Search ..... 415/53 T, 213 T, 104, 415/106; 417/366, 410, 423 R, 365

[56] References Cited

U.S. PATENT DOCUMENTS

| | | | |
|---|---|---|---|
| 1,146,079 | 7/1915 | Krogh | 415/106 |
| 1,611,004 | 12/1926 | Derrick | 415/106 |
| 1,865,396 | 6/1932 | Claypool | 415/213 T |
| 2,003,350 | 6/1935 | Durdin | 415/53 T |
| 2,864,552 | 12/1958 | Anderson | 417/365 |
| 3,119,343 | 1/1964 | White | 417/423 R |
| 3,160,108 | 12/1964 | Sence | 415/106 |
| 3,259,072 | 7/1966 | Carpenter | 415/213 T |
| 3,418,991 | 12/1968 | Shultz et al. | 417/423 R |
| 3,518,021 | 6/1970 | Lake et al. | 415/198.2 |
| 3,871,797 | 3/1975 | Igarashi et al. | 415/106 |
| 4,209,284 | 6/1980 | Lochmann et al. | 417/366 |

FOREIGN PATENT DOCUMENTS

| | | | |
|---|---|---|---|
| 673780 | 6/1952 | United Kingdom | 415/213 T |
| 453493 | 1/1975 | U.S.S.R. | 415/104 |

*Primary Examiner*—William L. Freeh
*Assistant Examiner*—Paul F. Neils
*Attorney, Agent, or Firm*—Cushman, Darby & Cushman

[57] ABSTRACT

An electrically operated fuel pump device comprises a regenerative pump component and an electric motor component operatively connected to the regenerative pump component to actuate the same. The regenerative pump component includes a pump casing having spaced inner surfaces thereof cooperating with each other to define therebetween a pump chamber. An impeller is disposed within the pump chamber rotatably and axially movably. Clearances are defined between axial end faces of the impeller and the inner surfaces of the pump casing, respectively. Liquid fuel increased in pressure to a discharge pressure by the rotation of the impeller is introduced into the clearances to act on the axial end faces of the impeller so as to minimize the direct contact of the axial end faces of the impeller with the respective inner surfaces of the pump casing.

8 Claims, 10 Drawing Figures

ELECTRICALLY OPERATED FUEL PUMP DEVICE HAVING A REGENERATIVE COMPONENT

BACKGROUND OF THE INVENTION

1. Field of the Invention

The present invention relates to an electrically operated fuel pump device for forcedly delivering liquid fuel from a fuel reservoir to a fuel consumption installation, and more particularly, to an electrically operated fuel pump device for forcedly delivering liquid fuel from a fuel tank to an engine combustion chamber of vehicles, for example.

2. Description of the Prior Art

In general, an electrically operated fuel pump device used to forcedly deliver liquid fuel within a fuel tank to an engine combustion chamber of vehicles, for example, is required to supply the fuel at a relatively high discharge pressure of 2–3 Kg/cm$^2$. Therefore, most of such fuel pump devices utilize a positive displacement pump. There are also fuel pump devices using a centrifugal pump. However, the use of such fuel pump devices is limited to a case where the fuel is delivered at a relatively low discharge pressure below 1 Kg/cm$^2$.

The fuel pump device which utilizes the positive displacement pump has such disadvantages that the manufacturing cost is high, because a desired performance is not obtained as far as the manufacturing accuracy or tolerance is not increased, and that vibration and noise are increased because of high fluctuation in discharge pressure. In addition, the fuel pump device utilizing the centrifugal pump can obtain low pressure and high flow rate, but is difficult to obtain high pressure and low flow rate.

The inventors of the present application have directed their attention to the use of a closed vane type regenerative pump or Westco pump as a pump for the fuel pump device. It is possible for the regenerative pump to obtain a discharge pressure of order of 2–3 Kg/cm$^2$. However, the fuel pump device utilizing the regenerative pump has such a problem that suitable clearances must be constantly maintained between opposite axial inner surfaces of a pump casing and opposite axial end faces of an impeller, respectively, to prevent the axial end faces of the impeller from being in contact with the inner surfaces of the pump casing, thereby to avoid a decrease in pump performance resulted from an increase in frictional torque due to the direct contact between the axial end faces of the impeller and the inner surfaces of the pump casing. Two ways are considered to solve such problem. The first way is to accurately position the impeller on a rotatable shaft to fix the impeller thereto. The second way is to mount the impeller on the rotatable shaft for axial movement therealong and to inaccurately balance the pressure acting on the axial end faces of the impeller with each other. However, any of such ways cause another problem that the entire fuel pump device is increased in manufacturing cost, because it is required to considerably increase the manufacturing accuracy or tolerance of the pump parts.

SUMMARY OF THE INVENTION

An object of the present invention is to provide an electrically operated fuel pump device which can minimize the decrease in pump performance due to the direct contact between the impeller and the pump casing and can decrease the manufacturing cost.

According to the present invention, there is provided an electrically operated fuel pump device comprising a regenerative pump comoponent and an electric motor component operatively connected to the regenerative pump component to actuate the same, the regenerative pump component comprising: a pump casing having inner surfaces thereof in axially opposed, but spaced relation to each other, the inner surfaces of the pump casing cooperating with each other to define therebetween a pump chamber, the pump casing further having defined therein suction and discharge ports communicated with the pump chamber; an impeller operatively connected to the electric motor component and disposed within the pump chamber rotatably around a rotational axis and axially movably therein, liquid fuel being sucked into the pump chamber through the suction port, increased in pressure to a discharge pressure and discharged from the pump chamber through the discharge port when the impeller is rotated in the pump chamber, the impeller having axial end faces thereof cooperating with the inner surfaces of the pump casing to define first and second clearances therebetween, respectively; pressure introducing means for introducing the liquid fuel at the discharge pressure into the first and second clearances to cause the liquid fuel to act on the axial end faces of the impeller to minimize the direct contact of the axial end faces of the impeller with the respective inner surfaces of the pump casing.

BEIEF DESCRIPTION OF THE DRAWINGS

DETAILED DESCRIPTION OF THE PREFERRED EMBODIMENT

Figure 1:
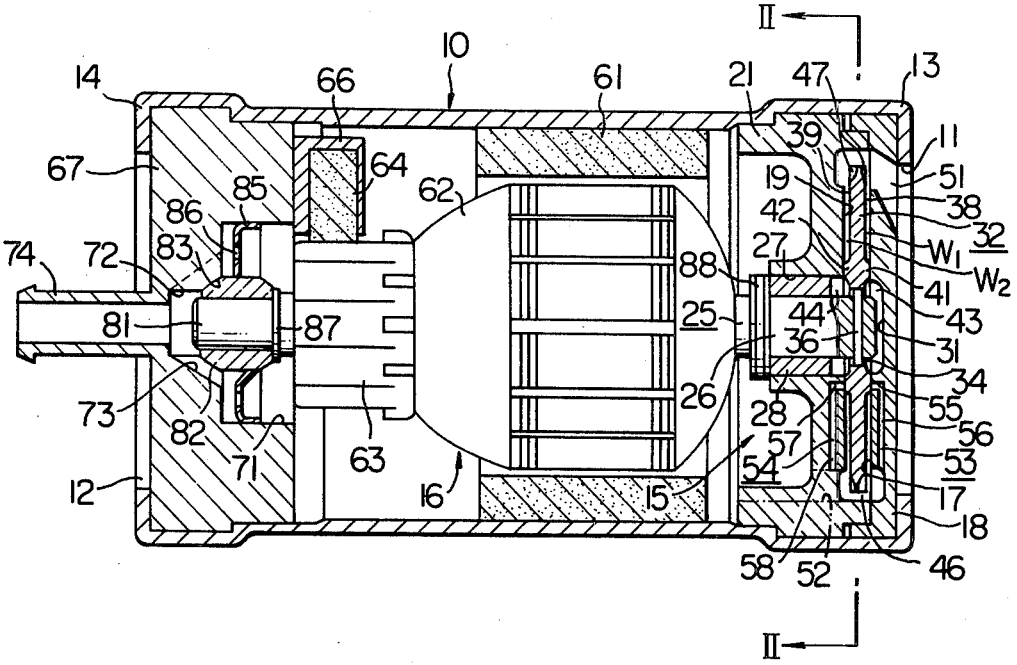
FIG. 1 is a longitudinal cross-sectional view of an electrically operated fuel pump device in accordance with a first embodiment of the present invention and is a cross-sectional view taken along the line I—I of FIG. 2.

Referring to FIG. 1, there is shown in longitudinal cross-section an electrically operated fuel pump device in accordance with a first embodiment of the present invention. The fuel pump device is adapted to be immersed in liquid fuel within a fuel tank of a vehicle, for example. The fuel pump device comprises a generally cylindrical housing 10 including one and the other axial end walls 13 and 14 thereof which have formed therein openings 11 and 12, respectively. The fuel pump device further comprises a regenerative pump component 15 disposed within the housing 10 adjacent to the one axial end wall 11 and an electric motor component 16 disposed within the housing 10 adjacent to the regenerative pump component. The motor component 16 is operatively connected to the regenerative pump component 15 to actuate the same.

The regenerative pump component 15 includes a pump casing which comprises a first casing section 18 having an inner surface 17 and an outer surface substantially closing the opening 11 in the one axial end wall 13 of the housing 10 and a second casing section 21 having its inner surface 19 in opposed, but axially spaced relation to the inner surface 17 of the first casing section 18. The inner surfaces 17 and 19 cooperate with each other to define a pump chamber therebetween.

A shaft 25 has its axis extending in concentric relation to the housing 10. The shaft 25 has one axial end portion 26 thereof which is rotatably supported in a central axial bore 27 formed in the second casing section 21 through a bearing 28. The one axial end portion 26 of the shaft 25 extends through the pump chamber and has an end face located within a central recess 31 formed in the inner surface 17 of the first casing section 18.

A generally disc-like impeller 32 is mounted on the shaft 25 for rotation within the pump chamber. The impeller 32 has a central axial bore 33 (FIG. 2) into which the one axial end portion 26 of the shaft 25 is fitted. A pair of axial grooves 34 are formed in the wall surface of the central bore 33 in diametrically opposed relation to each other. A pin 36 having a circular cross-section extends diametrically through the one axial end portion 26 of the shaft 25 and has opposite end portions fitted in the pair of axial grooves 34, respectively. Thus, the impeller 32 is mounted on the shaft 25 for axial movement therealong, but against rotation relative to the shaft. The impeller 32 has one axial end face 38 thereof spaced from the inner surface 17 of the first casing section 18 by a slight clearance $W_1$ and the other axial end face 39 spaced from the inner surface 19 of the second casing section 21 by a slight clearance $W_2$. These clearances $W_1$ and $W_2$ are in fact extremely small in size, but are exaggeratedly shown in FIG. 1. Annular projections 41 and 42 are integrally formed on the one and the other axial end faces 38 and 39 of the impeller, respectively and have a height smaller than the clearance $W_1$ and $W_2$ so that the narrowest portions of the clearances $W_1$ and $W_2$ are defined by the annular projections 41 and 42, respectively.

Figure 2:
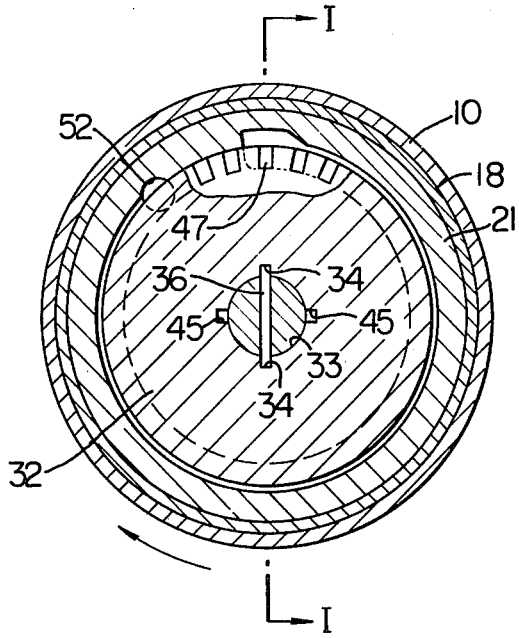
FIG. 2 is a cross-sectional view taken along the line II—II of FIG. 1.

The annular projection 41 cooperates with the recess 31 in the first casing section 18 and the outer peripheral surface and end face of the one axial end portion 26 of the shaft 25 to define a chamber 43 radially inwardly of the annular projection 41. The annular projection 42 cooperates with the central axial bore 27 in the second casing section 21, an axial end face of the bearing 28 and the outer peripheral surface of the one axial end portion 26 of the shaft 25 to define a chamber 44 radially inwardly of the annular projection 42. As best shown in FIG. 2, a second pair of diametrically opposed axial grooves 45 are formed in the wall surface of the central axial bore 33 in the impeller 32 to communicate the chambers 43 and 44 with each other, thereby to cause the fluid pressures within the chambers 43 and 44 to be balanced with each other.

The impeller 32 has an outer peripheral portion thereof which cooperates with the pump chamber defined in the pump casing 18, 21 to define an arcuate pump flow passage 46. The outer peripheral portion of the impeller has a plurality of vane grooves 47 formed in the one and the other axial end faces 38 and 39 of the impeller in circumferentially equi-distantly spaced relation to each other. The impeller 32 illustrated in the drawings is a so called "closed vane type impeller" in which the bottom surface of each vane groove 47 formed in the one axial end face 38 is not intersected with the bottom surface of each vane groove 47 formed in the other axial end face 39.

The pump flow passage 46 is communicated with liquid fuel within a fuel reservoir, not shown, through a suction port 51 formed in the first casing section 18 and is communicated with a space within the housing 10 through a discharge port 52 formed in the second casing section 18. The discharge port 52 does not in fact appear in FIG. 1 which is a cross-sectional view taken along the line I—I of FIG. 2, but is shown in FIG. 1 by a phantom line for convenience.

A pressure introducing passageway comprises a first passage section 53 formed in the first casing section 18 and a second passage section 54 formed in the second casing section 21. The first passage section 53 comprises a plurality of interconnected axial bores 55 circumferentially spaced from each other along the annular projection 41 on the one axial end face 38 of the impeller 32. Only one of such axial bores 55 is shown in FIG. 1. Each of the axial bores 55 opens to the narrowest portion of the clearance $W_1$ defined by the annular projection 41. The first passage section 53 further comprises a radial bore 56 having one end thereof connected to one of the interconnected axial bores 55 and the other end opening to a portion of the pump flow passage 46 facing the discharge port 52. The second passage section 54 comprises a plurality of interconnected axial bores 57 circumferentially spaced from each other along the annular projection 42 on the other axial end face 39 of the impeller 32. Only one of such axial bores 57 is shown in FIG. 1. Each of the axial bores 57 opens to the narrowest portion of the clearance $W_2$ defined by the annular projection 42. The second passage section 53 further comprises a radial bore 58 having one end thereof connected to one of the interconnected axial bores 57 and the other end opening to a portion of the discharge port 52 adjacent to the pump flow passage 46.

The electric motor component 16 comprises a pair of generally semi-cylindrical permanent magnets 61 disposed within the housing 10 in concentric relation to the shaft 25, an armature 62 fixedly mounted on the shaft 25 in concentric relation to the permanent magnet 61, and a commutator 63 fixedly mounted on the shaft 25 and connected to the armature 62. A brush 64 is in sliding contact with the commutator 63 and is held by a brush holder 66 secured to an end block 67 which is disposed within the housing 10 so as to substantially close the opening 12 in the other axial end wall 14 of the housing. The end block 67 has a central recess 71 formed in one axial end face of the end block exposed to the space within the housing 10 and a second central recess 72 formed in the bottom surface of the central recess 71. A plurality of grooves 73 are formed in the side wall surface of the second recess 72 in circumferentially spaced relation to each other. Each of the grooves 73 has its inclined bottom surface and an end opening to the bottom surface of the central recess 71. The end block 67 has formed integrally therewith a hollow projection 74 extending outwardly from the other axial end face of the end block. The projection 74 has therein a hollow portion which communicates with the second recess 72 and is adapted to be connected to a fuel consumption installation, not shown, such as an engine, for example.

The shaft 25 has the other axial end portion 81 which is rotatably supported by a bearing 82 seated on a seat 83 formed by chamfering the edge of the second recess 72. The bearing 82 is held in position by an annular retainer 85 disposed within the central recess 71. The retainer 85 has formed therein a plurality of circumferentially spaced bores 86. The shaft 25 is held in radial position by the retainer 85 and is held in axial position by a spacer 87 mounted on the shaft 25 in contact with an axial end face of the bearing 82 and a spacer 88 mounted on the shaft 25 in contact with an axial end face of the bearing 28.

In operation, electric current from an electric power source, not shown, is applied to the commutator 63 through the brush 64 to rotate the armature 62. The rotation of the armature 62 is transmitted to the impeller 32 through the shaft 25 to cause the impeller to be rotated in the clockwise direction as shown by an arrow in FIG. 2. The rotation of the impeller 32 causes the liquid fuel within the fuel reservoir to be delivered into the pump flow passage 46 through the suction port 51. The fuel is increased in pressure within the pump flow passage 46 by the action of the vane grooves 47 to a discharge pressure, and is discharged into the space within the housing 10 through the discharge port 52. The fuel flows through an annular gap between the permanent magnet 61 and the armature 62, the bores 86 in the retainer 85 and the grooves 73 in the end block 67, and is supplied to the fuel consumption installation through the hollow portion of the hollow projection 74.

As described previously, the clearances $W_1$ and $W_2$ are extremely small or narrow in actual size. Accordingly, although the clearances $W_1$ and $W_2$ are communicated with the pump flow passage 46, the liquid fuel pressure in portions of the clearances $W_1$ and $W_2$ adjacent to the radially outward peripheries of the annular projections 41 and 42 are lower than the liquid fuel pressure in the pump flow passage 46. Further, the liquid fuel pressure within the pump flow passage 46 is introduced into portions of the clearances $W_1$ and $W_2$ adjacent to the radially inward peripheries of the annular projections 41 and 42, or the chambers 43 and 44 through the narrowest portions of the clearances $W_1$ and $W_2$ respectively defined by the annular projections 41 and 42, and the liquid fuel at the discharge pressure in the space within the housing 10 is also introduced into the chambers 43 and 44 through a very slight peripheral gap between the bearing 28 and the one axial end portion 26 of the shaft 25. Accordingly, the pressure within the chambers 43 and 44 is lower than the discharge pressure.

Upon the rotation of the impeller 32, the fuel introduced into the pump flow passage 46 through the suction port 51 is increased in pressure in the pump flow passage 46 and reaches a discharge pressure or the maximum pressure at a portion of the pump flow passage 52 facing the discharge port 46. The fuel at the discharge pressure is introduced into the narrowest portion of the clearance $W_1$ defined by the annular projection 41 through the bores 56 and 55 of the first passage section 53, and into the narrowest portion of the clearance $W_2$ defined by the annular projection 42 through the bores 58 and 57 of the second passage section 54. Accordingly, for example, when the impeller 32 tends to be axially moved in the left in FIG. 1 to increase the size of the clearance $W_1$ and to decrease the size of the clearance $W_2$ so that the narrowest portion at the annular projection 42 is further narrowed and the narrowest portion at the projection 41 is widened, the urging force exerted on the annular projection 42 by the pressurized fuel introduced into the narrowest portion tending to be further narrowed becomes greater than that exerted on the annular projection 41 by the pressurized fuel introduced into the narrowest portion tending to be widened, so that the clearance $W_2$ tends to be widened and the clearance $W_1$ tends to be narrowed. Converces are also true. Thus, the impeller 32 is constantly maintained in its central position where the clearances $W_1$ and $W_2$ are made substantially equal in size to each other, and the direct contact of the annular projections 41 and 42 with the respective inner surface 17 and 19 of the pump casing is minimized.

As described above, since the impeller 32 is constantly maintained such that the axial end faces 38 and 39 of the impeller are respectively and substantially out of contact with the inner surfaces 17 and 19 of the pump casing, it is possible to minimize the decrease in pump performance resulted from the increase in frictional torque due to the direct contact of the impeller with the pump casing. Furthermore, it is unnecessary to accurately and fixedly position the impeller 32 on the shaft 25 and to accurately balance the pressures acting on the axial end faces of the impeller with each other. Thus, it is possible to decrease the manufacturing accuracy or tolerance of the pump parts so that the manufacturing cost of the entire pump device is reduced.

Figure 3:
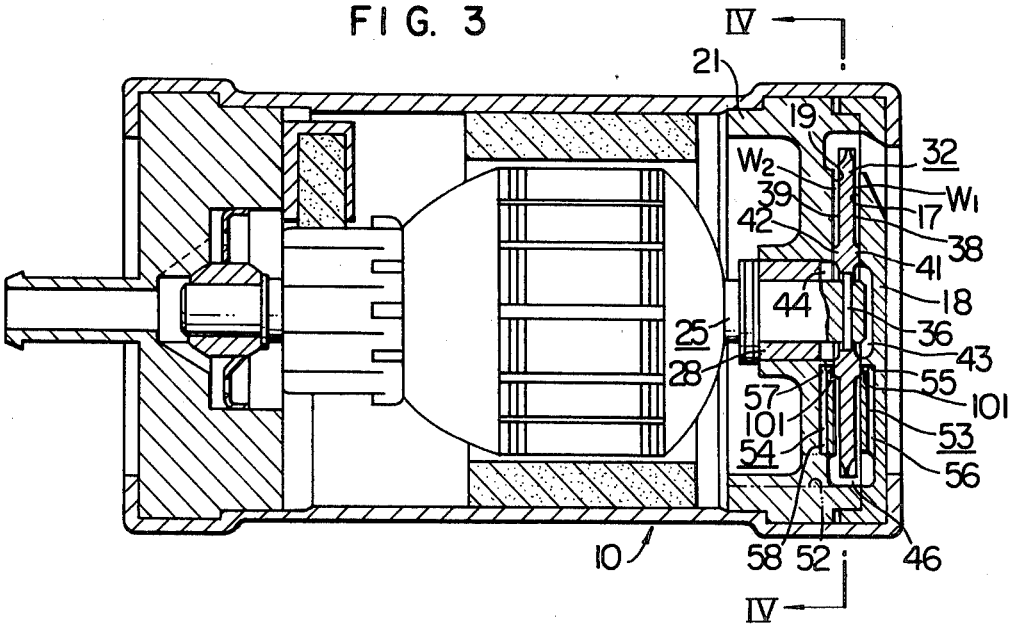
FIG. 3 is a view similar to FIG. 1, but showing a second embodiment of the present invention.
Figure 4:
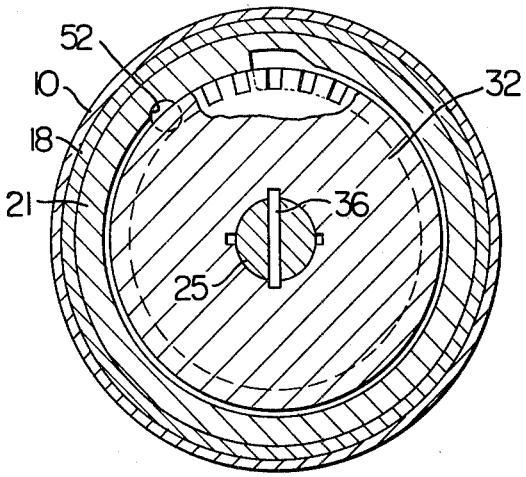
FIG. 4 is a cross-sectional view taken along the line IV—IV of FIG. 3.
Figure 5:
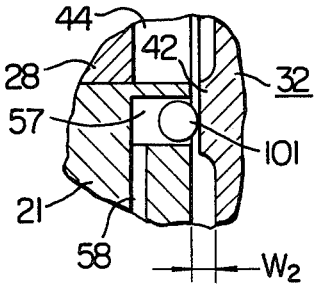
FIG. 5 is a fragmental enlarged cross-sectional view showing a ball in rolling contact with an axial end face of an impeller.

FIGS. 3 to 5 shows a second embodiment of the invention in which parts and portions common to the first embodiment described with reference to FIGS. 1 to 2 are designated by the same reference characters and the descriptions on such common parts and portions will be omitted for convenience. In the second embodiment shown in FIGS. 3 to 5, spherical members or balls 101 made of a resin having low coefficient of friction and having a diameter slightly less than the diameter of the axial bores 55 and 57 of the first and second passage sections 53 and 54 are received or clearance-fitted in the axial bores 55 and 57, respectively. The balls 101 are urged against the annular projections 41 and 42 by the pressurized fuel introduced into the first and second passage sections 53 and 54 so that the balls 101 are in rolling contact with the annular projections 41 and 42 upon the rotation of the impeller 32. Thus, the impeller 32 is located in a position where the clearances $W_1$ and $W_2$ are made substantially equal in size to each other.

Structure other than those described above and the function of the second embodiment are substantially identical with those of the first embodiment, and will not be repeated here. In the second embodiment, the balls 101 are in rolling contact with the annular projections 41 and 42 on the impeller 32 upon the rotating thereof. However, such rolling contact is considerably lower in friction than a sliding contact, and the functional advantages substantially identical with those of the first embodiment are also gained by the second embodiment. In addition, since the balls 101 are respectively received in the axial bores 55 and 57 of the first and second passage sections 53 and 54, there is additionally provided such functional advantage that the leak or the fuel flow rate discharged into the narrowest portions of the clearances $W_1$ and $W_2$ through the open ends of the axial bores 55 and 57 is restrained to a lower level.

Figure 6:
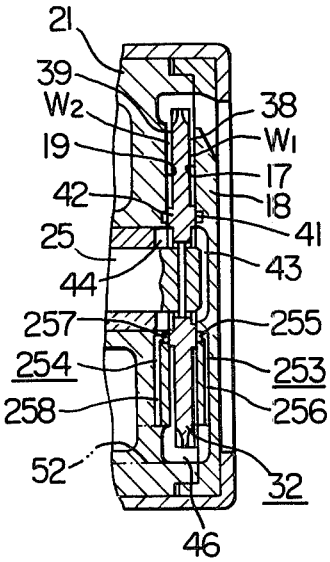
FIG. 6 is a fragmental cross-sectional view showing a third embodiment of the present invention.

FIG. 6 illustrates a third embodiment of the present invention in which the same reference characters are applied to parts and portions common to the first embodiment described with reference to FIGS. 1 and 2, and the descriptions on such common parts and portions will be omitted for convenience.

In the third embodiment shown in FIG. 6, a first passage section 253 corresponding to the first passage section 53 in the first embodiment which constitutes a pressure introducing passageway comprises an arcuate groove 255 formed in the inner surface 17 of the first casing section 18 so as to extend along the annular projection 41 on the impeller 32 and a radial bore 256 communicated with the arcuate groove 255. A second passage section 254 corresponding to the second passage section 54 in the first embodiment comprises an arcuate groove 257 fromed in the inner surface 19 of the second casing section 21 so as to extend along the annular projection 42 on the impeller 32 and a radial bore 258 communicated with the arcuate groove 257.

Structures other than those described above and the function of the third embodiment are substantially identical with those of the first embodiment, and will not be repeated here.

As described above, the first to third embodiments of the present invention are arranged such that the liquid fuel at the discharge pressure is introduced into the narrowest portions of the clearances $W_1$ and $W_2$ by the pressure introducing passageway which comprises the first and second passage sections 53, 54; 253, 254 so that the clearances $W_1$ and $W_2$ are constantly maintained substantially equal in size to each other.

Accordingly, the impeller 32 is maintained such that the axial end faces 38 and 39 of the impeller are substantially out of contact with the respective inner surfaces 17 and 19 of the pump casing, to effectively minimize the decrease in pump performance resulted from the increase in frictional torque due to the direct contact of the impeller with the pump casing. In addition, since it is unnecessary to accurately and fixedly position the impeller 32 on the shaft 25 and to accurately balance the pressures acting on the axial end faces of the impeller with each other, it is possible to decrease the manufacturing accuracy or tolerance of the pump parts, thereby to reduce the manufacturing cost.

The present invention has been described as having the annular projections 41 and 42 formed on the impeller 32. Alternatively, however, such annular projections may be formed on the inner surfaces 17 and 19 of the pump casing. Moreover, the annular projections 41 and 42 may not be provided. In such case, the clearances $W_1$ and $W_2$ are actually measured to find out the narrowest portions thereof, and the fuel at the discharge pressure may be introduced into the measured narrowest portions of the clearances. In addition, the first and second passage sections have been described as introducing the fuel adjacent to the discharge port 52 into the narrowest portions of the clearances, but may introduce the liquid fuel at the discharge pressure downstream of the discharge port 52 into the narrowest portions.

Figure 7:
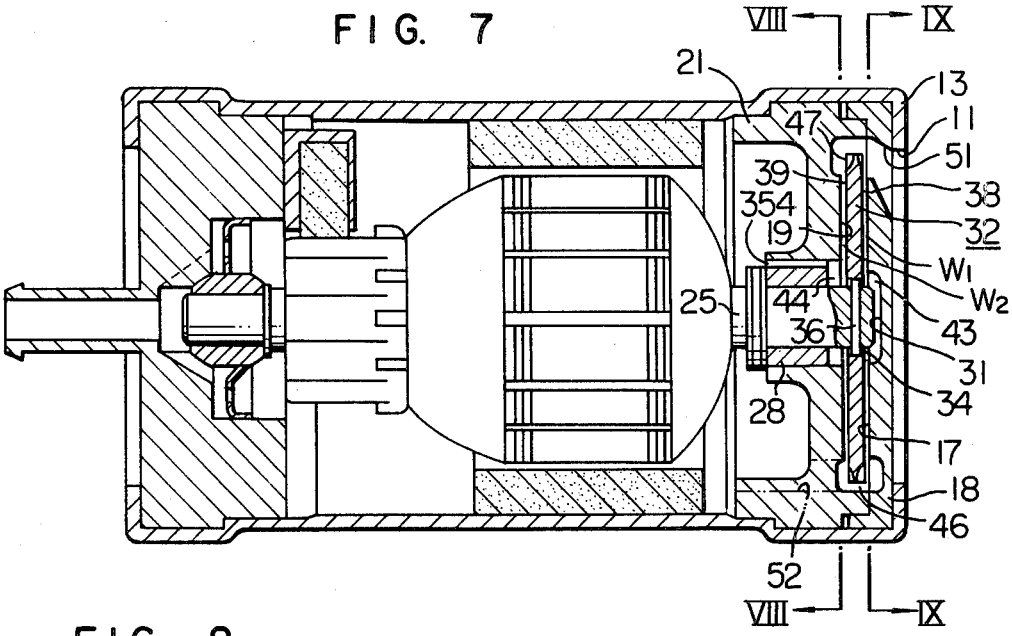
FIG. 7 is a view similar to FIG. 1, but showing a fourth embodiment of the invention.
Figure 8:
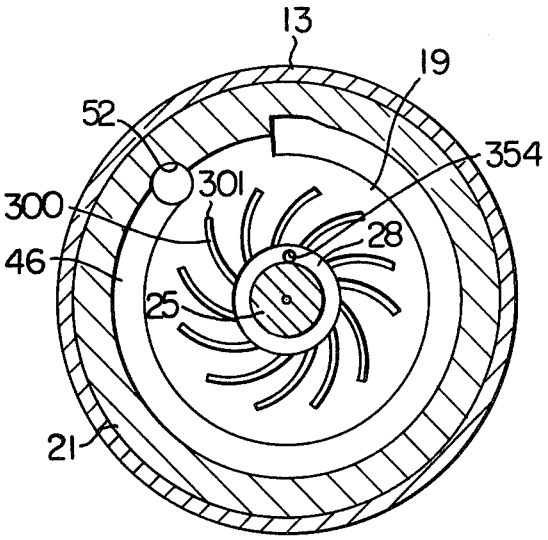
FIG. 8 is a cross-sectional view taken along the line VIII—VIII of FIG. 7.
Figure 9:
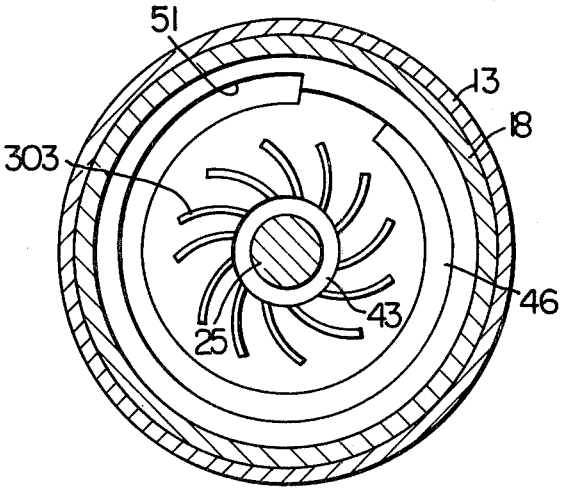
FIG. 9 is a cross-sectional view taken along the line IX—IX of FIG. 7.

FIGS. 7 to 9 show a fourth embodiment of the present invention in which the same reference characters are applied to parts and portions common to the first embodiment described with reference to FIGS. 1 to 2, and the descriptions on such common parts and portions will be omitted for convenience. In the fourth embodiment shown in FIGS. 7 to 9, any of the impeller 32 and the pump casing 18, 21 have no annular projections corresponding to the annular projections 41 and 42 in the first embodiment. In the fourth embodiment, a pressure introducing passageway comprises a plurality of radial grooves 301 (FIG. 8) formed in the inner surface 19 of the second casing section 21 in circumferentially equi-distantly spaced relation to each other with each radial groove 300 having one end thereof communicated with the chamber 44 and the other closed end 301, and a plurality of radial grooves 303 (FIG. 9) formed in the inner surface 17 of the first casing section 18 in circumferentially equi-distantly spaced relation to each other with each radial groove 303 having one end thereof communicated with the chamber 43 and the other closed end. The pressure introducing passageway further comprises an axial bore 354 formed in the second casing section 21 and having one end opening to the space within the housing 10 and the other end communicated with the chamber 44 which is communicated with the chamber 43 through axial grooves not shown in FIGS. 7 to 9 corresponding to the axial grooves 45 shown in FIG. 2. The liquid fuel at the discharge pressure downstream of the discharge port 52 is introduced into the radial grooves 300 through the axial bore 354 and the chamber 44 to act on the axial end face 39 of the impeller 32 to urge the same in the right in FIG. 7, and is also introduced into the radial grooves 303 through the axial bore 354, chamber 44, axial grooves corresponding to the axial grooves 45 in FIG. 2 and the chamber 43 to act on the axial end face 38 of the impeller 32 to urge the same in the left in FIG. 7, so that the impeller 32 is constantly located in a position where the clearances $W_1$ and $W_2$ are made substantially equal in size to each other and the impeller is substantially maintained out of contact with the pump casing.

The radial grooves 300 and 303 are curved in the rotational direction of the impeller 32 to cause the pressurized fuel to smoothly flow along the radial grooves. However, the grooves may extend radially outwardly in a straight manner.

Figure 10:
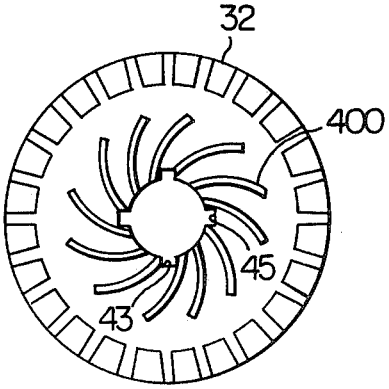
FIG. 10 is a front elevational view of an impeller used in a modification of the embodiment shown in FIG. 7.

FIG. 10 illustrates a modification of the fourth embodiment shown in FIG. 7. In the modification in FIG. 10, radial grooves 400 similar to the radial grooves 300, 303 in the fourth embodiment are formed in each of the axial end faces 38 and 39 of the impeller 32, in place of the radial grooves 300, 303.

What is claimed in:

1. An electrically operated fuel pump device comprising a regenerative pump component and an electric motor component operatively connected to said regenerative pump component to actuate the same, said regenerative pump component comprising:

a pump casing having inner surfaces thereof in axially opposed, but spaced relation to each other, said inner surfaces of said pump casing cooperating with each other to define therebetween a pump chamber, said pump casing further having defined therein suction and discharge ports communicated with said pump chamber;

an impeller operatively connected to said electric motor component and disposed within said pump chamber rotatably around a rotational axis and axially movably therein, liquid fuel being sucked into said pump chamber through said suction port, increased in pressure to a discharge pressure and discharged from said pump chamber through said discharge port when said impeller is rotated in said pump chamber, said impeller having axial end faces thereof cooperating with said inner surfaces of said pump casing to define first and second clearances therebetween, respectively;

pressure introducing means for introducing the liquid fuel at the discharge pressure into said first and second clearance to cause the liquid fuel to act on said axial end faces of said impeller to minimize the direct contact of said axial end faces of said impeller with said respective inner surfaces of said pump casing, a common housing having disposed therein said regenerative pump component and said electric motor component, said discharge port being communicated with a space within said housing, wherein said pressure introducing means introduces the liquid fuel at the discharge pressure into the narrowest portion of said first clearance and into the narrowest portion of said second clearance, an annular projection formed on one of each of said inner surfaces of said pump casing and each of said axial end faces of said impeller in concentric relation to the rotational axis of said impeller, said annular projections on one of said inner surfaces of said pump casing and said axial end faces of said impeller projecting toward and cooperating with the other of said inner surfaces of said pump casing and axial end faces of said impeller to define said narrowest portions of said first and second clearances, respectively, wherein said annular projections are integrally formed on said axial end faces of said impeller, respectively.

2. A fuel pump device defined in claim 1, wherein said pressure introducing means comprises first and second passages formed in said pump casing, said first passage having one end thereof opening to one of said narrowest portions of said first and second clearances and the other end opening to said discharge port, said second passage having one end thereof opening to the other narrowest portion and the other end opening to a portion of said pump chamber at said discharge port.

3. A fuel pump device defined in claim 2, wherein said annular projections cooperate with said inner surfaces of said pump casing to respectively define first and second chambers radially inwardly of said annular projections, said regenerative pump component further including communicating means for communicating said first and second chambers with each other to balance the fluid pressures within said first and second chambers with each other.

4. A fuel pump device defined in claim 3, wherein said regenerative pump component further includes a shaft connected to said electric motor component, said impeller being mounted on said shaft for rotation therewith and for axial movement therealong, said impeller having therein a central bore into which said shaft is fitted, said communicating means comprising at least one axial groove formed in a wall surface of said bore in said impeller.

5. An electrically operated fuel pump device comprising a regenerative pump component and an electric motor component operatively connected to said regenerative pump component to actuate the same, said regenerative pump component comprising:

a pump casing having inner surfaces thereof in axially opposed, but spaced relation to each other, said inner surfaces of said pump casing cooperating with each other to define therebetween a pump chamber, said pump casing further having defined therein suction and discharge ports communicated with said pump chamber;

an impeller operatively connected to said electric motor component and disposed within said pump chamber rotatably around a rotational axis and axially movably therein, liquid fuel being sucked into said pump chamber through said suction port, increased in pressure to a discharge pressure and discharged from said pump chamber through said discharge port when said impeller is rotated in said pump chamber, said impeller having axial end faces thereof cooperating with said inner surfaces of said pump casing to define first and second clearances therebetween, respectively;

pressure introducing means for introducing the liquid fuel at the discharge pressure into said first and second clearance to cause the liquid fuel to act on said axial end faces of said impeller to minimize the direct contact of said axial end faces of said impeller with said respective inner surfaces of said pump casing, wherein said pressure introducing means introduces the liquid fuel at the discharge pressure into the narrowest portion of said first clearance and into the narrowest portion of said second clearance, an annular projection formed on one of each of said inner surfaces of said pump casing and each of said axial end faces of said impeller in concentric relation to the rotational axis of said impeller, said annular projections on one of said inner surfaces of said pump casing and said axial end faces of said impeller projecting toward and cooperating with the other of said inner surfaces of said pump casing and axial end faces of said impeller to define said narrowest portions of said first and second clearances, respectively, wherein said annular projections are integrally formed on said axial end faces of said impeller, respectively, wherein said pressure introducing means comprises first and second passages formed in said pump casing, said first passage having one end thereof opening to one of said narrowest portions of said first and second clearances and the other end opening to said discharge port, said second passage having one end thereof opening to the other narrowest portion and the other end opening to a portion of said pump chamber at said discharge port, and wherein said pressure introducing means further comprises spherical members clearance-fitted in said one end of said first and second passages and in rolling contact with each of said axial end faces of said impeller upon the rotation thereof.

6. An electrically operated fuel pump device comprising a regenerative pump component and an electric motor component operatively connected to said regenerative pump component to actuate the same, said regenerative pump component comprising:

a pump casing having inner surfaces thereof in axially opposed, but spaced relation to each other, said inner surfaces of said pump casing cooperating with each other to define therebetween a pump chamber, said pump casing further having defined therein suction and discharge ports communicated with said pump chamber;

an impeller operatively connected to said electric motor component and disposed within said pump chamber rotatably around a rotational axis and axially movably therein, liquid fuel being sucked into said pump chamber through said suction port, increased in pressure to a discharge pressure and discharaged from said pump chamber through said discharge port when said impeller is rotated in said pump chamber, said impeller having axial end faces thereof cooperating with said inner surfaces of said pump casing to define first and second clearances therebetween, respectively;

pressure introducing means for introducing the liquid fuel at the discharge pressure into said first and second clearance to cause the liquid fuel to act on said axial end faces of said impeller to minimize the direct contact of said axial end faces of said impeller with said respective inner surfaces of said pump casing, a common housing having disposed therein said regenerative pump component and said electric motor component, said discharge port being communicated with a space within said housing, wherein said pressure introducing means introduces the liquid fuel at the discharge pressure into the narrowest portion of said first clearance and into the narrowest portion of said second clearance, an annular projection formed on one of each of said inner surfaces of said pump casing and each of said axial end faces of said impeller in concentric relation to the rotational axis of said impeller, said annular projections on one of said inner surfaces of said pump casing and said axial end faces of said impeller projecting toward and cooperating with the other of said inner surfaces of said pump casing and axial end faces of said impeller to define said narrowest portions of said first and second clearances, respectively, wherein said annular projections are integrally formed on said axial end faces of said impeller, respectively, wherein said pressure introducing means comprises first and second passages formed in said pump casing, said first passage having one end thereof opening to one of said narrowest portions of said first and second clearances and the other end opening to said discharge port, said second passage having one end thereof opening to the other narrowest portion and the other end opening to a portion of said pump chamber at said discharge port, and wherein said pressure introducing means further comprises spherical members clearance-fitted in said one end of said first and second passages and in rolling contact with each of said axial end faces of said impeller upon the rotation thereof.

7. A fuel pump device defined in claim 6 or 5, wherein said annular projections cooperate with said inner surfaces of said pump casing to respectively define first and second chambers radially inwardly of said annular projections, said regenerative pump component further including communicating means for communicating said first and second chambers with each other to balance the fluid pressures within said first and second chambers with each other.

8. A fuel pump device defined in claim 7, wherein said regenerative pump component further includes a shaft connected to said electric motor component, said impeller being mounted on said shaft for rotation therewith and for axial movement therealong, said impeller having therein a central bore into which said shaft is fitted, said communicating means comprising at least one axial groove formed in a wall surface of said bore in said impeller.

* * * * *